US006137506A

United States Patent [19]

Sueoka

[11] Patent Number: 6,137,506

[45] **Date of Patent: *Oct. 24, 2000**

[54] INK JET RECORDING HEAD WITH A PLURALITY OF ORIFICE PLATES

[75] Inventor: Manabu Sueoka, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/489,956

[22] Filed: Jun. 13, 1995

[30] Foreign Application Priority Data

Jun. 13, 1994 [JP] Japan ..... 6-154203

[51] Int. Cl.[7] ..... B41J 2/145; B41J 2/14

[52] U.S. Cl. ..... 347/40; 347/47

[58] Field of Search ..... 347/43, 47, 40

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,881,318 | 11/1989 | Komuro et al. | 29/827 |
| 4,908,638 | 3/1990 | Albosta et al. | 346/140 |
| 5,343,227 | 8/1994 | Hirosawa | 349/42 |
| 5,347,713 | 9/1994 | Shibata et al. | 29/890.1 |
| 5,479,197 | 12/1995 | Fujikawa et al. | 347/63 |
| 5,580,468 | 12/1996 | Fujikawa et al. | 216/27 |
| 5,612,724 | 3/1997 | Murakami et al. | 347/64 |
| 5,621,440 | 4/1997 | Takahashi | 347/12 |
| 5,745,135 | 4/1998 | Hirabayashi et al. | 347/16 |
| 5,757,400 | 5/1998 | Hoisington | 347/40 |
| 5,790,151 | 8/1998 | Mills | 347/47 |

FOREIGN PATENT DOCUMENTS

| | | |
|---|---|---|
| 54-51837 | 4/1979 | Japan . |
| 59-95154 | 6/1984 | Japan . |
| 59-123670 | 7/1984 | Japan . |
| 59-138461 | 8/1984 | Japan . |

*Primary Examiner*—Safet Metjahic
*Assistant Examiner*—Christopher E. Mahoney
*Attorney, Agent, or Firm*—Fitzpatrick, Cella, Harper & Scinto

[57] ABSTRACT

The present invention provides an ink jet recording head that includes a substrate with a plurality of elements for generating energy for discharging ink, and a plurality of orifice plates having a plurality of orifices for discharging the ink. These orifice plates are attached to the substrate so that the orifices are disposed above the plurality of energy generating elements, and a slit is provided between the respective orifice plates. The present invention also provides an ink jet recording apparatus incorporating such an ink jet recording head.

27 Claims, 6 Drawing Sheets

FIG. 8 - PRIOR ART
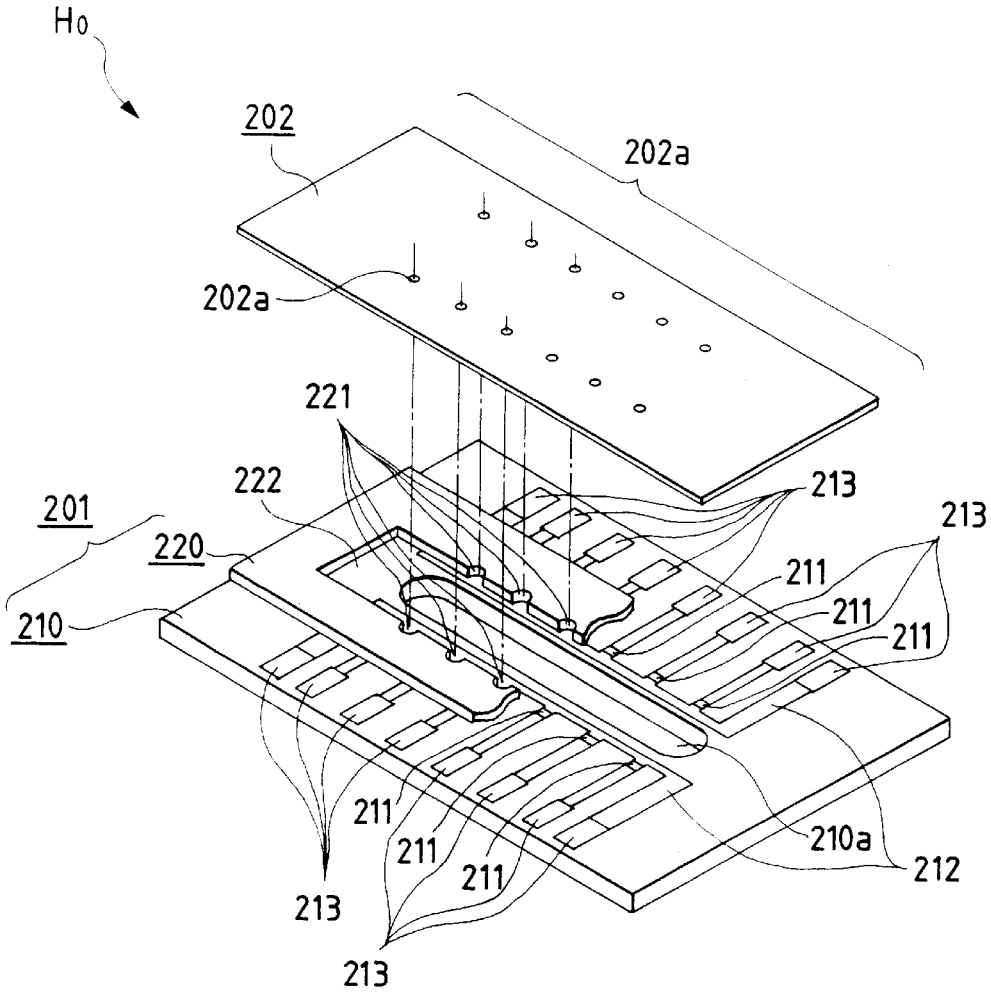
FIG. 9
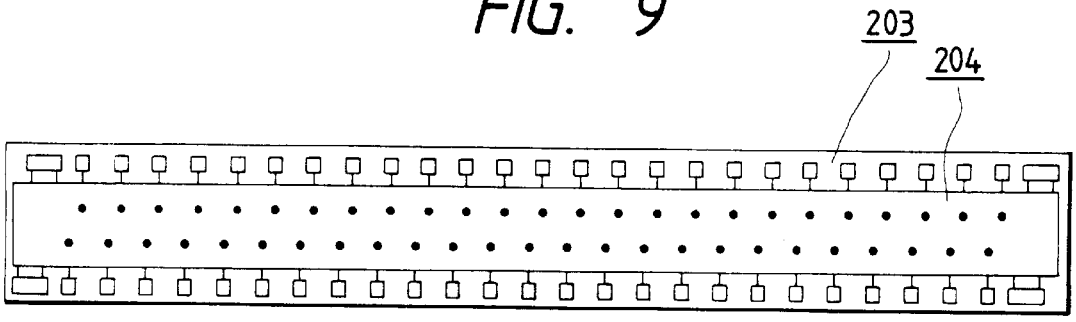

INK JET RECORDING HEAD WITH A PLURALITY OF ORIFICE PLATES

BACKGROUND OF THE INVENTION

1. Field of the Invention

The present invention relates to an ink jet recording head for forming a liquid ink droplet by discharging liquid ink from at least one orifice, and more particularly, it relates to an ink jet recording head wherein ink is discharged toward a direction perpendicular to a substrate having a plurality of discharge energy generating means for discharging the ink, and an ink jet recording apparatus having such a head.

2. Related Background Art

Regarding ink jet recording heads of this kind, for example, an ink jet recording method disclosed in the Japanese Patent Application Laid-Open No. 54-51837 has a feature different from the other ink jet recording methods, in the point that a power for discharging a liquid droplet is obtained by applying thermal energy to liquid.

That is to say, the recording method disclosed in the above Japanese Gazette is characterized in that liquid subjected to thermal energy is heated to generate a bubble which discharges a liquid droplet from an orifice provided at an end of a recording head, and the liquid droplets are adhered to a recording material to form an image corresponding to image information.

A recording head used in this method generally comprises a substrate on which electrical/thermal converters for generating thermal energy are provided and a recording head portion formed from resin layers or metal layers for forming liquid passages and a common liquid chamber communicated with liquid discharge orifices, and connection wirings for supplying electrical energy to the electrical/thermal converters and drive circuits are formed on the substrate as printed circuits. Surfaces of the connection wirings and the electrical/thermal converters are coated by an insulating layer made of $SiO_2$ and the like and a protection layer made of metallic material such as Ta and the like.

Further, for example, as disclosed in the Japanese Patent Application Laid-Open No. 59-95154, there has been proposed a recording head of a type wherein liquid is discharged in a direction perpendicular to a heat acting plane by attaching an orifice plate to a substrate.

FIG. 8 shows an example of a conventional recording head. In this example, a recording head Ho comprises a substrate 210 such as a silicone wafer, a heater board 201 comprised of a resin layer 220 laminated on the substrate, and an orifice plate 202 provided on the resin layer 220, and the substrate 210 is provided at its central portion with an ink supplying aperture 210*a*. Electrical/thermal converter elements 211 disposed in two rows and electrodes 213 connected to the corresponding electrical/thermal converter elements 211 via connection wirings 212 are arranged on a surface of the substrate 210. The surfaces of these elements 211–213 are covered by an insulation layer (not shown) which is in turn coated on a metallic protection layer. The protection layer serves to prevent the insulation layer from being damaged due to cavitation. Further, the resin layer 220 is provided with liquid passages 221 open to the respective electrical/thermal converter elements 211, and a common liquid chamber communicated with the aperture 210*a* of the substrate 210. The orifice plate 202 has orifices 202*a* communicated with the corresponding liquid passages 221 formed in the resin layer 220.

The orifice plate 202 is integrally formed from metal such as nickel, stainless steel or the like, or suitable resin, and is adhered to the surface of the heater board 210 by adhesive or the like.

In such an ink jet recording head, a high speed operation has been requested. In order to achieve the high speed operation, the ink jet recording head can be elongated. That is to say, by increasing a recording width of the ink jet recording head, the number of dots which can be recorded at a time is increased, thereby improving the recording speed.

As a typical example of such an ink jet recording head, there is an ink jet recording head of full-line type. Since the ink jet recording head of full-line type has a print width (recording width) greater than a width of a recording material (recording medium), the recording can be effected by shifting the recording material without shifting the recording head, thereby achieving high speed recording.

As the above-mentioned ink jet recording head of full-line type wherein ink is discharged in the direction perpendicular to the heat acting plane, there has been proposed an elongated head constituted by adhering an elongated orifice plate 204 to an elongated heater board 203, as shown in FIG. 9.

The orifice plate of the above-mentioned ink jet recording head of full-line type wherein ink is discharged in the direction perpendicular to the heat acting plane generally has a thickness of 20 to 100 $\mu$m so that a distance between the orifices and the heat generating portions (heaters) is not so increased. In consideration of such small thickness of the plate and the manufacturing accuracy of the orifices, the orifice plate is normally made of metal or resin. On the other hand, the substrate generally comprises a silicon substrate. When the orifice plate and the substrate are made of different materials in this way, although there is no problem in case of normal size head, if the head is made elongated, due to the difference in coefficient of linear expansion between these materials, during the driving of the heaters or the manufacture of the head, there arises a positional deviation between the heat generating portions and the orifices, which results in the risk that the flying direction of the ink droplet becomes unstable and the orifice plate is peeled from the substrate due to the stress acting in the orifice plate.

When the orifice plate is made of resin, there arises the same problem as mentioned above, because of the curing and contraction of the resin during the curing process.

Further, as mentioned above, since the orifice plate is very thin, it is very difficult to manufacture the elongated orifice plate with high accuracy.

SUMMARY OF THE INVENTION

The present invention aims to eliminate the above-mentioned conventional drawbacks, and an object of the present invention is to provide an ink jet recording head of the type wherein ink is discharged in a direction perpendicular to a heat acting plane, in which there is no positional deviation between orifices and heat generating portions even when change in temperature occurs.

Another object of the present invention is to provide an ink jet recording head which has an orifice plate which can easily be manufactured with high accuracy.

The other object of the present invention is to provide an ink jet recording head in which the recording can be effected at a high speed in a reliable manner.

To achieve the above objects, according to the present invention, there is provided an ink jet recording head comprising a substrate having a plurality of discharge energy generating means for generating energy for discharging ink, and a plurality of orifice plates having a plurality of orifices for discharging the ink, and wherein the plurality of orifice plates are attached to the substrate so that the orifices are disposed above the plurality of discharge energy generating means, and a slit is provided between the orifice plates.

BRIEF DESCRIPTION OF THE DRAWINGS

FIG. 8 is a schematic exploded perspective view showing a conventional ink jet recording head; and FIG. 9 is a schematic plan view showing a conventional elongated ink jet recording head.

DETAILED DESCRIPTION OF THE PREFERRED EMBODIMENTS

Figure 1:
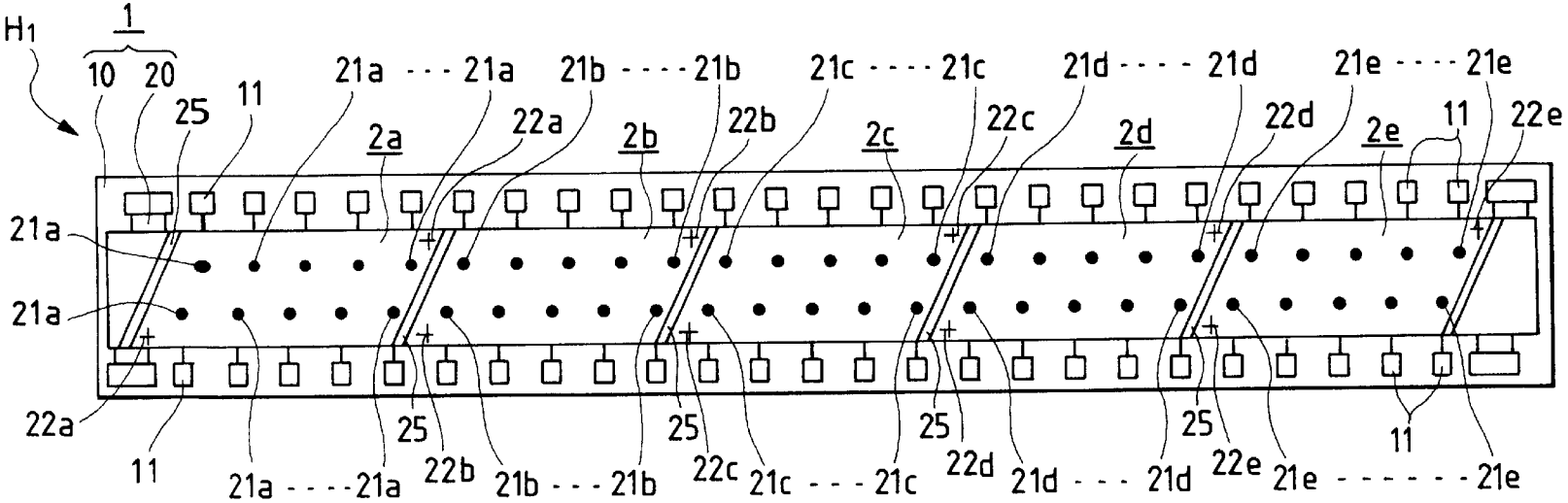
FIG. 1 is a schematic plan view of an ink jet recording head according to an embodiment of the present invention.
Figure 2:
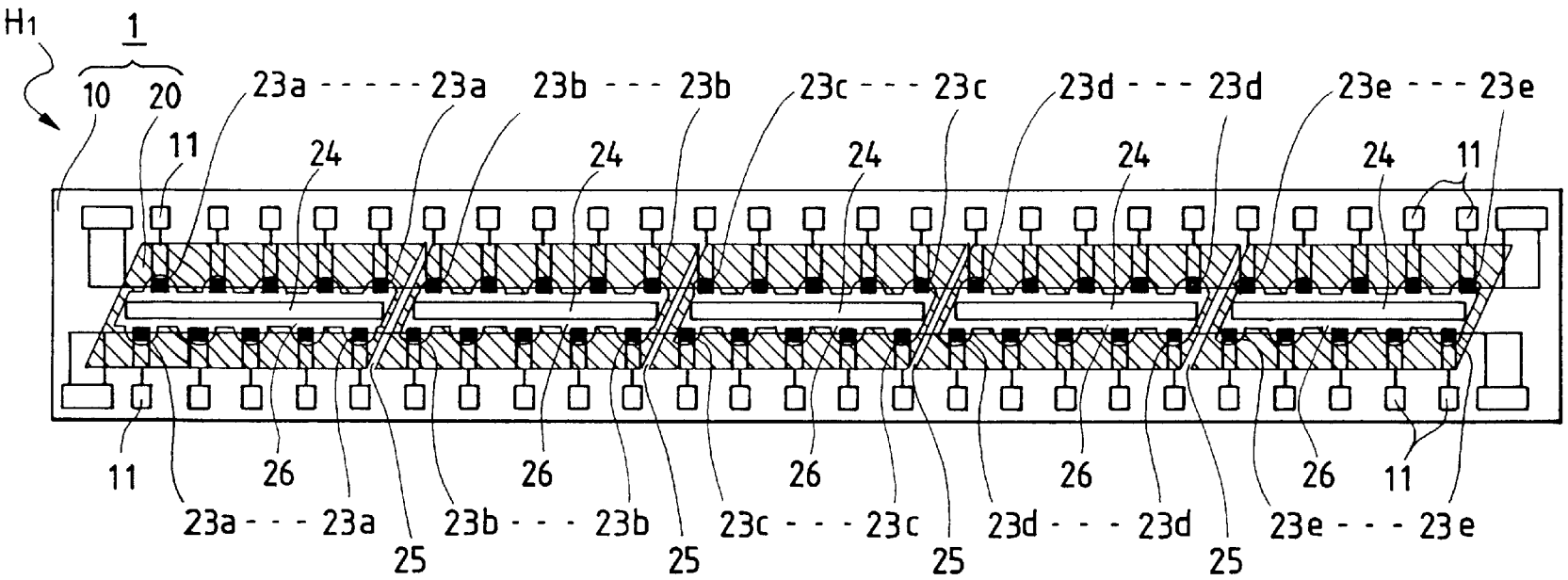
FIG. 2 is a schematic plan view of the ink jet recording head of FIG. 1 showing a condition before orifice plates are attached.
Figure 3:
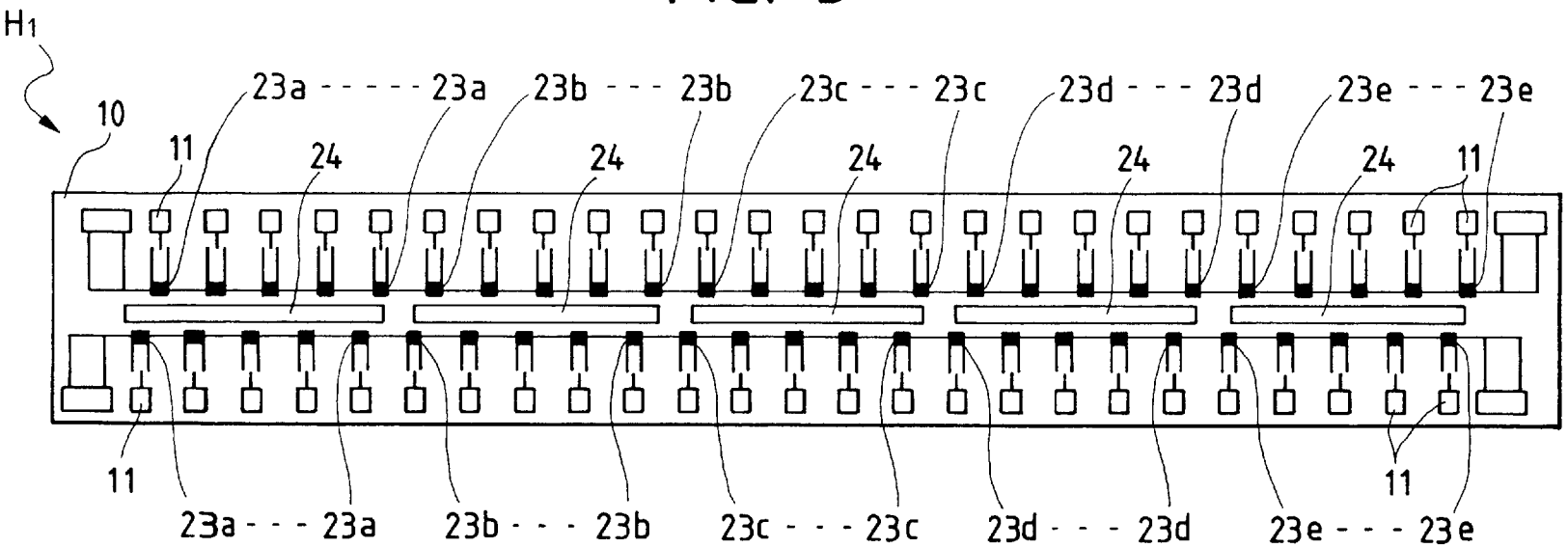
FIG. 3 is a schematic plan view showing a substrate of the ink jet recording head of FIG. 1.

FIG. 1 is a schematic plan view of an ink jet recording head according to an embodiment of the present invention, FIG. 2 is a schematic plan view of the ink jet recording head of FIG. 1 showing a condition before orifice plates are attached, and FIG. 3 is a schematic plan view showing a substrate of the ink jet recording head of FIG. 1.

In FIGS. 1 to 3, heat generating resistive bodies (discharge energy generating means) 23 for generating energy utilized to discharge ink, and electrodes 11 electrically connected to the heat generating resistive bodies 23 are formed on a silicone substrate 10. Further, on the silicone substrate 10, there are provided an insulation layer (not shown) and a protection layer (not shown) such as a cavitation layer in order to protect the heat generating resistive bodies and the electrodes. Further, ink supply apertures 24 is formed in the silicone substrate, through which the ink is supplied to the recording head. A resin layer 20 serves to define ink passage walls, and ink passages 26 separated by the resin layer serves to reserve the ink therein. The ink passages are communicated with the ink supply apertures 24. Orifice plates 2*a*–2*e* are provided with two rows of orifices 21 for discharging the ink and define a portion of each ink passage.

The orifice plate according to the present invention are divided into several portions 2*a*–2*e* by oblique transverse slits 25. Since the slits 25 are formed between the orifices 21, the pitch between the orifices of each orifice plate portion is not deviated from that of the other orifice plate portion, with the result that the orifices can be arranged as is in the conventional single orifice plate. By dividing the orifice plate in this way and by providing the slits between the orifice plate portions, even when the orifice plate is expanded by the temperature change, since the deviation of the orifice plate with respect to the substrate can be compensated by the slits, the discharge accuracy is not subjected to a bad influence. Further, even if the orifice plate is subjected to camber, such camber is dispersed by the orifice plate portions, thereby preventing the orifice plate from peeling from the substrate. In addition, since the orifice plate portions can be made small-sized, the orifice plate can cheaply be manufactured with high accuracy.

The orifice plate portions are provided with positioning marks 22*a*–22*e* so that these portions can easily be positioned with respect to the substrate by aligning these marks 22*a*–22*e* with corresponding marks formed on the substrate. Since the orifice plate portions have oblique edges, by providing the positioning marks 22*a*–22*e* in the acute angle portions, the orifice plate portions can easily be positioned with respect to each other and with respect to the substrate merely by aligning the positioning marks with each other and with the substrate marks.

As mentioned above, orifices are arranged in two rows, and the orifices in the upper row are offset from the orifices in the lower row by ½ pitch. By arranging the orifices in such an offset manner, the recording density can be increased by twice without decreasing the pitch between the orifices.

As is in the orifice plate, the resin layer 20 is provided with slits, and the plurality of ink passages 26 are defined by the resin layer 20. Since the slits 25 are disposed between the orifices (heat generating resistive bodies), the resin layer 20 must have partition walls for isolating the ink passages adjacent to the slit. However, when the orifices are arranged with high density, an adequate space for providing the partition walls cannot be reserved. In this case, by arranging the orifices in three or four rows, the pitch between orifices in each row can be increased, thereby permitting the provision of the partition walls.

Figure 5:
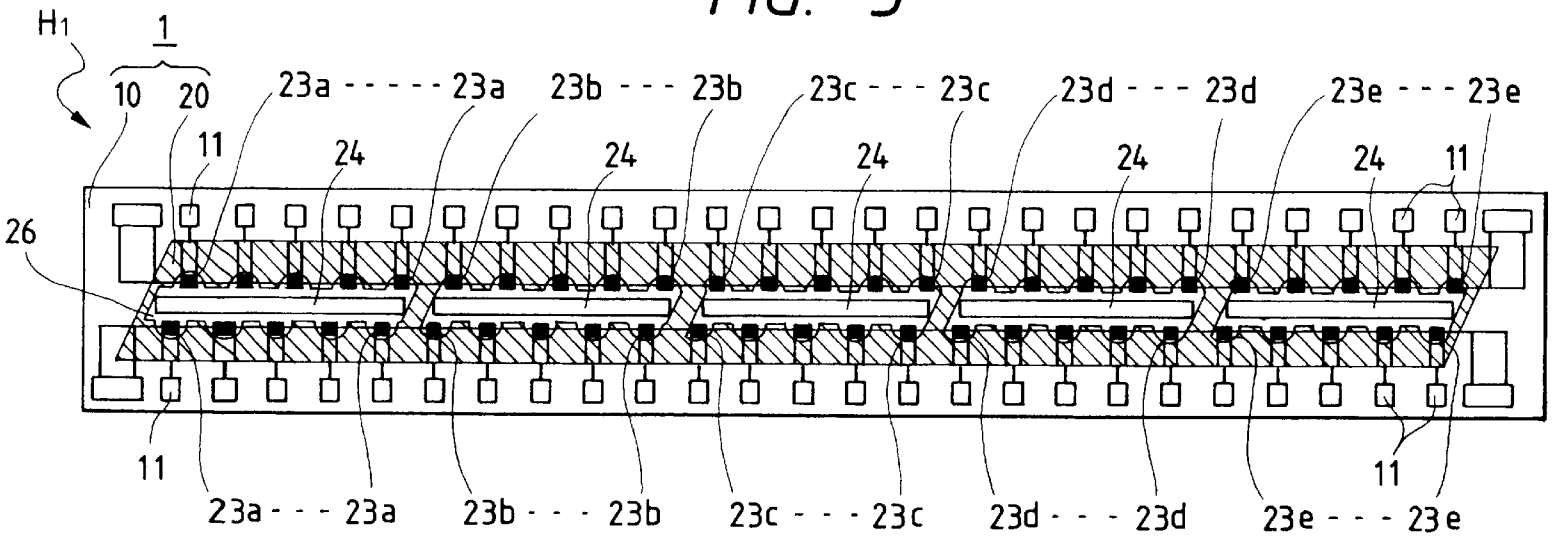
FIG. 5 is a schematic plan view of an ink jet recording head similar to that of FIG. 2, wherein a resin layer is formed from a single pattern.

In the illustrated embodiment, while an example that the resin layer 20 has the slits 25 was explained, as shown in FIG. 5, the resin layer may be a single piece, and only the orifice plate may be divided by the slits. Also in this case, the same technical advantage can be achieved. In this case, since the slits are not formed in the resin layer, the partition walls can be thinned, thereby permitting high density arrangement of the orifices.

The ink supply apertures 24 are formed in the substrate as through openings which do not interface with zones to which the slits are overlapped. With this arrangement, the strength of the substrate can be increased in comparison with the conventional substrate wherein a single elongated ink supply aperture is formed.

Figure 4:
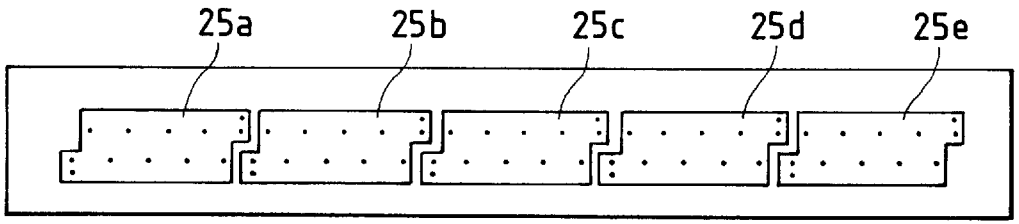
FIG. 4 is a schematic plan view showing an ink jet recording head in which crank-shaped slits are provided.

In the illustrated embodiment, while the oblique slits were used, as shown in FIG. 4, crank-shaped slits may be used. Also in this case, the same technical advantage can be achieved.

Next, the concrete method for manufacturing the ink jet recording head according to the above-mentioned embodiment will be explained.

First of all, the head generating resistive layer made of $HfB_2$ and the electrode layer made of Al are successively laminated on the silicone wafer by the thin film forming technique such as spattering. Then, these layers are patterned to form the heat generating resistive bodies and the electrodes. Then, the heat generating resistive bodies and the electrodes are covered by the insulation layer made of $SiO_2$, and the anti cavitation layer is provided on the heat generating portions. Thereafter, the silicone wafer is cut to a desired dimension, and the through openings for the ink supply apertures are formed in the wafer. In this way, the substrate (heater board) is completed.

Then, a dry film acting as the resin layer is laminated on the heater board, and the dry film is patterned to form the resin layer as shown in FIG. 2. Then, a plurality of orifice plate portions previously formed from metal such as nickel, stainless steel or resin by electroforming or molding technique are attached to the upper surface of the resin layer on the heater board at predetermined positions by referring to the above-mentioned positioning marks. In this way, the ink jet recording head is completed.

In the above explanation, while the resin layer was formed from the dry film, resin may be coated on the heater board by spin coating or the like. Further, in the above explanation, while the orifice plate was formed independently from the resin layer, when the orifice plate is made of resin, the orifice plate may be formed integrally with the resin layer by molding or by coating resin on a soluble ink passage forming material.

According to the illustrated embodiment, since the orifice plate of the large or elongated recording head is divided into a small orifice plate portions and the orifice plate portions are independently attached to the heater board, the attaching of the orifice plate to the heater board can easily be effected in comparison with the case where the single elongated orifice plate is manufactured and then is attached to the heater board, and the process for manufacturing the orifice plate itself can be simplified. Further, since the small orifice plate portions are attached to the heater board independently, the positional deviation between the orifice caused due to the difference in coefficient of linear expansion between the heater board and the orifice plate can be suppressed to the minimum extent, thereby preventing the flying direction of the ink droplet from becoming unstable. As a result, the cheaper recording head having high efficiency can be obtained.

Figure 6:
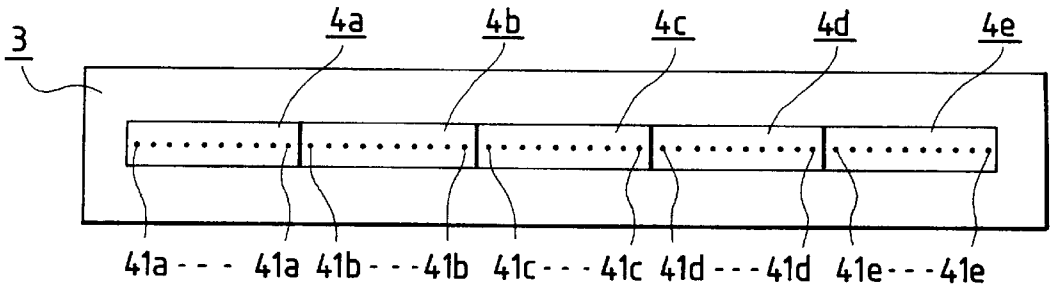
FIG. 6 is a schematic plan view showing an alteration of the ink jet recording head.

FIG. 6 shows an alteration. In this alteration, the recording head comprises a heater board 3 having electrical/thermal converter elements arranged in a line, and orifice plate portions 4*a*–4*e* attached to a resin layer of the heater board. Each orifice plate portion 4*a*–4*e* has a row of orifices 41*a*–41*e* communicated with liquid passages formed in the resin layer. When the orifices are arranged in a line in this way, since the width of the orifice plate is small, it is very difficult to treat a single elongated orifice plate. Thus, the advantage that the orifice plate is divided into a plurality of orifice plate portions is extremely useful.

Next, an ink jet recording apparatus to which the ink jet recording head according to the present invention is applied will be explained with reference to FIG. 7.

Figure 7:
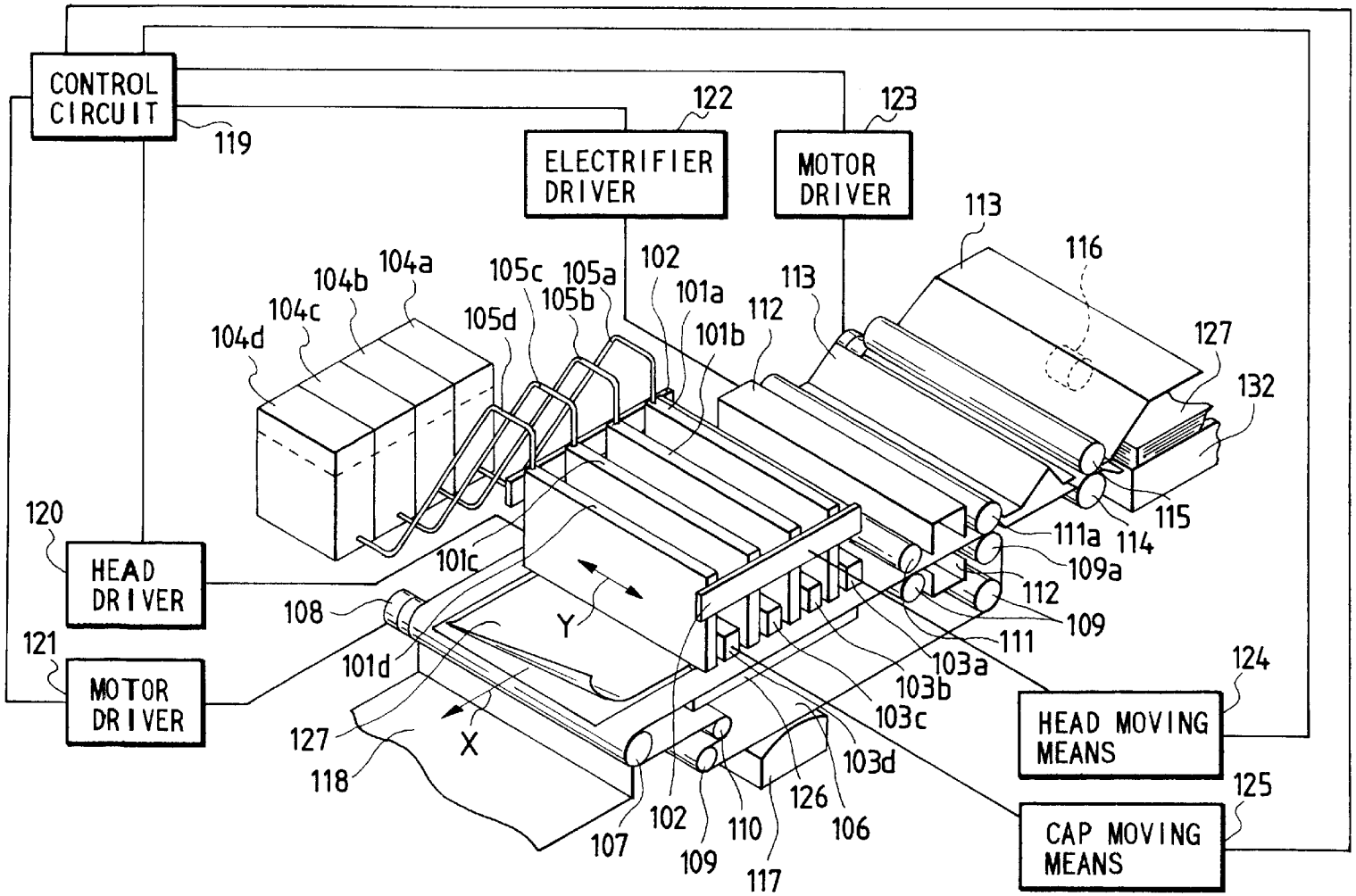
FIG. 7 is a schematic perspective view of an ink jet recording apparatus to which the ink jet recording head according to the present invention is applied.

In FIG. 7, the recording apparatus comprises recording heads of line type (referred to merely as "heads" hereinafter) 101*a*–101*d* which are supported by a holder 102 in such a manner that they are spaced apart from each other by a predetermined distance in an X direction. Each head 101*a*–101*d* is provided at its lower surface with a row of 3456 discharge openings (16 openings per 1 mm), thereby obtaining a recording width of 216 mm.

The heads 101*a*–101*d* are of the type wherein recording liquid (ink) is discharged by utilizing thermal energy, and the discharge of ink is controlled by a head driver 120.

Incidentally, the heads 101*a*–101*d* and the holder 102 constitute a head unit which can be shifted by a head moving means 124 in an up-and-down direction.

Caps 103*a*–103*d* are disposed below the heads 101*a*–101*d* in a confronting relation to the latter, and ink absorbing members made of sponge and the like are contained in the caps, respectively.

The caps 103*a*–103*d* are fixedly supported by a holder (not shown). The caps 103*a*–103*d* and the holder constitute a cap unit which can be shifted in the X direction by a cap moving means 125.

Cyan color ink, magenta color ink, yellow color and black color ink are supplied from ink tanks 104*a*–104*d* to the heads 101*a*–101*d* through ink supply tubes 105*a*–105*d*, respectively, thereby permitting the color recording.

The supply of ink is effected by utilizing capillary phenomenon in the head discharge openings, and a liquid surface in each ink tank 104*a*–104*d* is maintained at a level below the position of the discharge openings by a predetermined distance.

A belt 106 serves to convey a recording sheet 127 and comprises a chargeable seamless belt.

The belt 106 is moved along a predetermined path by a drive roller 107, an idle rollers 109, 109*a* and a tension roller 110. The belt is driven by a belt drive motor 108 connected to the drive roller 107 and controlled by a moter driver 121.

The belt 106 is shifted in the X direction immediately below the discharge openings of the heads 101*a*–101*d*, and, in this area, the belt movement is stabilized by a stationary support member 126.

Below the belt 106, there is provided a cleaning unit 117 for removing foreign matters such a paper powder adhered to the surface of the belt 106.

A charger 112 for charging the belt 106 is ON/OFF controlled by an electrifier driver 122, and, when the charger is turned ON, an electrostatic absorbing force is generated to absorb the recording sheet 127 to the belt 106.

Pinch rollers 111, 111*a* cooperating with the idle rollers 109, 101*a* to urge the recording sheet 127 against the belt 106 are disposed on both sides of the charger 112.

The recording sheets 127 contained in a sheet supply cassette 113 are supplied one by one by means of a sheet supply roller 116, and the supplied recording sheet is conveyed to an angle guide 113 by means of a convey roller 114 and a pinch roller 115 driven by a motor driver 123. The angle guide 113 has a V-shaped space for permitting the flexion of the recording sheet 127.

After the recording is finished, the recording sheet 127 is discharged onto a sheet discharge tray 118.

The head driver 120, head moving means 124, cap moving means 125, motor drivers 121, 123 and electrifier driver 122 are controlled by a control circuit 119.

The present invention gives excellent advantage, particularly, in an ink jet recording head wherein the recording is effected by forming flying ink droplets by utilizing thermal energy, among recording heads of liquid injecting type.

The typical construction and principle of such a recording head is disclosed in U.S. Pat. Nos. 4,723,129 and 5,740,796, for example, and, preferably, the present invention can be realized by using such fundamental principles. The recording system can be applied to both a so-called "on-demand type" and "continuous type".

Explaining this recording system briefly, it is more effective when the present invention is particularly applied to the on-demand type, because, by applying at least one drive signal corresponding to the record information and capable of providing the abrupt temperature increase exceeding the nucleate boiling of recording liquid (ink) to the electrical/thermal converters arranged in correspondence to the sheet or liquid passages including the recording liquid therein, it is possible to form a bubble in the liquid in correspondence to the drive signal by generating the film boiling on the heat acting surface of the recording head due to the generation of the thermal energy in the electrical/thermal converters. Due to the growth and contraction of the bubble, the liquid (ink) is discharged from the discharge opening to form at least one liquid droplet. When the drive signal has a pulse shape, since the growth and contraction of the bubble can be quickly effected, more excellent liquid (ink) discharge can be achieved. Such a pulse-shaped drive signal may be ones disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

As the construction of the recording head, the present invention includes the construction wherein the heat acting portion is disposed in an arcuate area as disclosed in U.S. Pat. Nos. 4,558,333 and 4,459,600, as well as the constructions wherein the discharge openings, liquid passages and electrical/thermal converters are combined (straight liquid passages or orthogonal liquid passages).

In addition, the present invention is applicable to the construction wherein each discharge opening is constituted by a slit with which a plurality of electrical/thermal converters are associated in common as disclosed in the Japanese Patent Application Laid-Open No. 59-123670 and the construction wherein openings for absorbing the pressure wave of the thermal energy are arranged in correspondence to the discharge openings as disclosed in the Japanese Patent Application Laid-Open No. 59-138461.

Further, the present invention can be applied to a recording head of full-line type having a length corresponding to a maximum width of a recording medium to be recorded.

Further, it is preferable that a head recovery means and an auxiliary aiding means are added to the ink jet recording head according to the present invention, since the effect of the present invention is further improved. More particularly, these means include a capping means for capping the recording head, a cleaning means, a pressurizing or suction means, and an auxiliary heating means comprising electrical/thermal converters or other heating elements or combination thereof. Further, it is effective for the stable recording to perform an auxiliary discharge mode wherein the ink discharge not relating to the recording ink discharge is effected.

Further, as to the recording mode of the recording apparatus, the present invention can effectively be applied not only to a recording mode with a single main color such as black, but also to a system providing a plurality of different colors and/or a full-color by mixing colors by using an integrated recording head or combination of plural recording heads.

In the present invention, the above-mentioned film boiling principle is most effective for each ink.

Further, the ink jet recording apparatus according to the present invention may be used as image output terminals of information processing systems such as computers or may be used with a copying machine incorporating a reader therein or a facsimile system having transmission/receiver function.

What is claimed is:

1. An ink jet recording head comprising:

a substrate having a plurality of discharge energy generating means for generating energy for discharging inks, wherein said discharge energy generating means are separated from one another by a first interval; and a plurality of orifice plates having a plurality of orifices for discharging the ink;

wherein said plurality of orifice plates are attached to said substrate so that said orifices are disposed above said discharge energy generating means, and each of the respective and adjacent orifice plates are separated from one another by a slit and said slit is disposed between at least some of the discharge energy generating means, and a second interval between those of said discharge energy generating means which are adjacent to the slit is substantially equal to the first interval.

2. An ink jet recording head according to claim 1, wherein the ink jet recording head is of full-line type.

3. An ink jet recording head according to claim 1, wherein a resin layer is provided on said substrate at position where said orifice plates are attached to said substrate.

4. An ink jet recording head according to claim 3, wherein said resin layer defines ink passage walls for forming ink passages communicated with said orifices.

5. An ink jet recording head according to claim 1, wherein said orifice plates are integrally provided with ink passage walls for forming ink passages communicated with said orifices.

6. An ink jet recording head according to claim 5, wherein said orifice plates are made of resin.

7. An ink jet recording head according to claim 1, wherein said slit is disposed obliquely with respect to an arrangement direction of said orifices.

8. An ink jet recording head according to claim 7, wherein positioning marks for positioning said plates with respect to said substrate are formed at acute angle portions of said orifice plates.

9. An ink jet recording head according to claim 1, wherein said slit has a stepped shape.

10. An ink jet recording head according to claim 1, wherein said substrate has a plurality of ink supply apertures comprised of a plurality of through openings.

11. An ink jet recording head according to claim 1, wherein said orifice plates have positioning marks for positioning said plates with respect to said substrate.

12. An ink jet recording head according to claim 1, wherein said discharge energy generating means comprises an electrical/thermal converter element.

13. An ink jet recording head according to claim 1, wherein said orifice plates are made of resin.

14. An ink jet recording apparatus comprising:

an ink jet recording head including a substrate having a plurality of discharge energy generating means for generating energy for discharging ink, wherein said discharge energy generating means are separated from one another by a first interval, and a plurality of orifice plates having a plurality of orifices for discharging the ink, wherein said plurality of orifice plates are attached to said substrate so that said orifices are disposed above said discharge energy generating means, and each of the respective and adjacent orifice plates are separated from one another by a slit and said slit is disposed between at least some of the discharge energy generating means, and a second interval between those of said discharge energy generating means which are adjacent to the slit is substantially equal to the first interval;

a holder for supporting said recording head;

a means for supplying an electrical signal to said discharge energy generating means of said recording head; and a convey means for conveying a recording medium to a position where the recording medium is opposed to said recording head.

15. An ink jet recording apparatus according to claim 14, wherein the ink jet recording head is of full-line type.

16. An ink jet recording apparatus according to claim 14, wherein a resin layer is provided on said substrate at position where said orifice plates are attached to said substrate.

17. An ink jet recording apparatus according to claim 16, wherein said resin layer defines ink passage walls for forming ink passages communicated with said orifices.

18. An ink jet recording apparatus according to claim 14, wherein said orifice plates are integrally provided with ink passage walls for forming ink passages communicated with said orifices.

19. An ink jet recording apparatus according to claim 18, wherein said orifice plates are made of resin.

20. An ink jet recording apparatus according to claim 14, wherein said slit is disposed obliquely with respect to an arrangement direction of said orifices.

21. An ink jet recording apparatus according to claim 20, wherein positioning marks for positioning said plates with respect to said substrate are formed at acute angle portions of said orifice plates.

22. An ink jet recording apparatus according to claim 14, wherein said slit has a stepped shape.

23. An ink jet recording apparatus according to claim 14, wherein said substrate has a plurality of ink supply apertures comprised of a plurality of through openings.

24. An ink jet recording apparatus according to claim 14, wherein said orifice plates have positioning marks for positioning said plates with respect to said substrate.

25. An ink jet recording apparatus according to claim 14, wherein said discharge energy generating means comprises an electrical/thermal converter element.

26. An ink jet recording apparatus according to claim 14, wherein a plurality of ink jet recording heads are provided to permit the recording with plural colors.

27. An ink jet recording apparatus according to claim 14, wherein said orifice plates are made of resin.

* * * * *

UNITED STATES PATENT AND TRADEMARK OFFICE

CERTIFICATE OF CORRECTION

PATENT NO. : 6,137,506
DATED : October 24, 2000
INVENTOR(S) : Manabu Sueoka

It is certified that error appears in the above-identified patent and that said Letters Patent is hereby corrected as shown below:

Column 3,
Line 47, "is formed" should read -- are formed --;
Line 50, "serves" should read -- serve --; and
Line 56, "plate" should read -- plates --.

Column 4,
Line 53, "head" should read -- heat --;
Line 56, "spattering" should read -- sputtering --; and
Line 60, "anti cavitation" should read -- anti-cavitation --.

Column 5,
Line 18, "a" should be deleted.

Column 6,
Line 15, "an" should be deleted;
Line 17, "moter" should read -- motor --; and
Line 23, "a" should read -- as --;
Line 31, "101a" should read -- 109a --; and
Line 51, "5,740,796," should read --4,740,796, --.

Column 7,
Line 7, "ones" should read -- those -- ; and
Line 62,"inks," should read -- ink, --.

UNITED STATES PATENT AND TRADEMARK OFFICE

CERTIFICATE OF CORRECTION

PATENT NO. : 6,137,506
DATED : October 24, 2000
INVENTOR(S) : Manabu Sueoka

It is certified that error appears in the above-identified patent and that said Letters Patent is hereby corrected as shown below:

Column 8,
Line 13, "position" should read -- a position --.

Column 9,
Line 4, "position" should read -- a position --.

Signed and Sealed this

Twenty-sixth Day of February, 2002

*Attest:*

*Attesting Officer*

JAMES E. ROGAN
*Director of the United States Patent and Trademark Office*